US005780824A

United States Patent [19]

Matos

[11] Patent Number: 5,780,824

[45] Date of Patent: Jul. 14, 1998

[54] EXPANDABLE AND SELF-VENTING NOVELTY CONTAINER FOR COOKING MICROWAVABLE POPCORN

[75] Inventor: Jose R. Matos, Plano, Tex.

[73] Assignee: Lulirama International, Inc., Dallas, Tex.

[21] Appl. No.: 796,980

[22] Filed: Feb. 7, 1997

[51] Int. Cl.[6] ..... H05B 6/80; B65D 81/34

[52] U.S. Cl. ..... 219/727; 219/735; 219/730; 99/DIG. 14; 426/107; 426/234; 426/118; 220/367.1; 229/903; 229/924

[58] Field of Search ..... 219/727, 730, 219/734, 735, 759; 99/DIG. 14; 426/107, 118, 113, 234, 243; 229/903, 924, 925, 926; 220/367.1

[56] References Cited

U.S. PATENT DOCUMENTS

| | | | |
|---|---|---|---|
| 3,973,045 | 8/1976 | Brandberg et al. | 426/110 |
| 4,013,798 | 3/1977 | Goltsos | 426/107 |
| 4,141,487 | 2/1979 | Faust et al. | 229/43 |
| 4,292,332 | 9/1981 | McHam | 426/111 |
| 4,404,241 | 9/1983 | Mueller et al. | 428/35 |
| 4,497,431 | 2/1985 | Fay | 219/735 |
| 4,571,337 | 2/1986 | Cage et al. | 426/107 |
| 4,574,174 | 3/1986 | McGonigle | 219/735 |
| 4,640,838 | 2/1987 | Isakson et al. | 426/107 |
| 4,940,158 | 7/1990 | Farrell et al. | 220/258 |
| 5,041,325 | 8/1991 | Larson et al. | 219/735 |
| 5,263,777 | 11/1993 | Domke | 426/118 |
| 5,294,764 | 3/1994 | Mass | 219/727 |
| 5,473,142 | 12/1995 | Mass | 219/727 |

FOREIGN PATENT DOCUMENTS

| | | | |
|---|---|---|---|
| 3-111276 | 5/1991 | Japan | 219/735 |
| 4-31273 | 2/1992 | Japan | 219/735 |

*Primary Examiner*—Philip H. Leung
*Attorney, Agent, or Firm*—Akin, Gump, Strauss, Hauer & Feld, L.L.P.

[57] ABSTRACT

The invention provides a sealed, expandable, automatically self-venting container for cooking microwavable foods in a microwave oven. The container has a pull-tab lid, a vent-hole, a vent-hole cover, an expandable casing, and a microwavable food charge such as corn kernels.

6 Claims, 3 Drawing Sheets

EXPANDABLE AND SELF-VENTING NOVELTY CONTAINER FOR COOKING MICROWAVABLE POPCORN

FIELD OF THE INVENTION

The present invention relates generally to containers for microwavable foods, and more specifically, to self-venting, expandable containers having a pull-tab lid for cooking microwavable foods in a microwave oven.

BACKGROUND OF THE INVENTION

Microwavable food represents a growing sector of the cooked foods industry. New containers for cooking microwavable foods are introduced almost yearly. There has been an increased demand for diversity in microwavable foods causing an increased need for new packaging configurations and materials.

Containers for cooking microwavable foods generally comprise a packaging material that is substantially microwave transparent. They are also generally not automatically self-venting in that they must be vented prior to cooking to avoid rupture of the container due to excessive internal pressure buildup.

Instructions for heating vapor-tight packages in a microwave oven usually call for first piercing each package with a sharp utensil. See, for example, FIG. 22 of U.S. Pat. No. 4,425,368 (Watkins). Vapor-tight frozen food packages which comprise polymeric or plastic film can be hard to pierce, and one may think that the film has been pierced when it has only been indented. If the film is not pierced, vapor pressures built up during heating may cause the package to explode. Instead of exploding, the package may rip at a seam through which the contents may spill out into the oven.

A number of self-venting, vapor-tight microwave oven packages have been proposed. Each of the packages shown in U.S. Pat. No. 4,013,798 (Goltsos) consists of a compartmented plastic tray across which is sealed a plastic film. A side wall of one or more of the compartments has a notch at which the plastic film is less well sealed so that a buildup of vapor pressure in a compartment breaks the seal at the notch to vent the compartment.

U.S. Pat. No. 4,292,332 (McHam) concerns a vapor-tight package for popping popcorn in a microwave oven. Its top wall is provided with lines of weakness that will begin to rupture at a vapor pressure less than that which would cause the bag to explode.

U.S. Pat. No. 4,141,487 (Faust et al.) concerns a vapor-tight package comprising a plastic film which is formed with a slit along a crease line. The edges of the slit are sealed together by an adhesive sealant material that melts below the cooking temperature to open the slit and thereby release vapors.

U.S. Pat. No. 4,404,241 (Mueller et al.) concerns a vapor-tight package comprising a heat-resistant sheet formed with apertures, and bonded to that sheet is a continuous heat-softening material which extends across the apertures. Rising temperatures and pressures within the package cause the heat-softening material to flow to create vents through the apertures.

U.S. Pat. No. 4,390,554 (Levinson) concerns a vapor-tight, multi-layer microwave oven package including a liquid-barrier plastic film 4 such as nylon or polyester which is "designed to vent at a preselected temperature by blow out plugs 13 or can be constructed of a low temperature plastic (as polyethylene) formulated to melt at a predetermined temperature". See col. 4, lines 30–40, and FIG. 1.

U.S. Pat. No. 4,210,674 (Mitchell) illustrates a tray which is hermetically sealed by a plastic film to which a narrow strip of aluminum foil is adhesively secured. When the aluminum foil has certain dimensions, it converts microwave energy to heat sufficient to melt the plastic film, thus venting the package.

Some automatically self-venting, expandable containers for microwavable foods, especially microwavable popcorn, have been developed. U.S. Pat. Nos. 3,973,045 to Brandberg et al., 4,571,337 to Cage et al., 4,640,838 to Isakson et al., and 5,473,142 to Mass, the disclosures of which are hereby incorporated by reference, generally cover containers for cooking microwavable popcorn in a microwave oven.

The '045 patent covers a microwavable popcorn gussetted bag made from a double ply paper having an inner greaseproof layer and an outer paper layer. The shape of the bag is generally similar to those now commercially available but has a different construction. The bag has a tape across its top to retain the bag closed during cooking. However, this bag is not intended to vent during heating of an enclosed charge of corn, fat and salt. The bag also has a rip means, such as a string, for use in opening.

The patent to Cage et al. covers a four-sided gussetted microwavable popcorn bag having a generally flattened bottom. The bag is made of a double ply paper wherein the inner layer is a grease "non-leaking" material and the outer layer is a paper. This patent covers many of the commercially available microwavable popcorn bag containers now available and is used by companies such as Orville Redenbocher. The bag has a top which automatically self-vents in response to buildup of internal heat and pressure during cooking and opens even further in response to pulling. During microwave heating of a corn and shortening or fat charge in the bag, the top of the bag partially opens in response to internal heat and pressure buildup to permit venting and avoid burning of the popcorn. This container can also have a microwave susceptor disposed between the plys of the double ply bag.

The '838 patent to Isakson et al. covers a self-venting vapor tight microwavable popcorn package. This patent is generally directed to an automatic self-venting mechanism which comprises a deposit adhered to and covering the vent hole of a microwavable package. The deposit comprises non-metallic, microwave-absorbing particles such as graphite and carbon black dispersed in a non-metallic binder. When a charge in the package is microwave heated, the non-metallic binder will loosen and melt to permit steam, heat and internal pressure to vent through the hole covered by the deposit.

The '142 patent is a continuation-in-part of U.S. Pat. No. 5,294,764 to Mass. Both patents generally cover microwavable popcorn containers in the shape of an animal or playball configuration wherein the container has a recloseable opening and a flexible outer casing. The container is generally intended to be made of a flexible plastic or a cloth material. The playball configuration as contemplated in the Mass patents generally includes football or spherical (round) balls.

Thus, none of the known containers for cooking microwavable foods, especially microwavable popcorn, in a microwave oven teach or suggest in the art of the invention as described and claimed herein.

SUMMARY OF THE INVENTION

One aspect of the present invention provides a container for cooking microwavable foods in a microwave oven. The container is sealed, expandable and automatically self-venting in response to buildup of internal heat and pressure caused by steam generation within the container during cooking of a microwavable food. Unlike other containers, the present container has a pull-tab lid with a removable portion to permit access to the cooked food. During cooking, the container will expand to a predetermined shape such as a cylinder, can, animal, person, caricature, building, vehicle, weapon, and the like.

In one embodiment, the invention provides a sealed, expandable, automatically self-venting container for cooking a microwavable food in a microwave oven comprising:

an expandable casing comprising a substantially microwave transparent, grease resistant, flexible panel;

a pull-tab lid, having an outer periphery, attached to said casing, said lid and casing together defining a sealed inner cavity and said pull-tab lid having a removable portion to permit access to said inner cavity;

an edge defining a vent-hole for said inner cavity;

a vent-hole cover covering the vent-hole comprising a sheet base and an adhesive interposed said sheet base and said edge defining a vent-hole;

a microwavable food charge, disposed within said cavity, that generates steam when exposed to microwaves in a microwave oven;

said casing expanding when said food charge is exposed to microwaves in a microwave oven; and said vent-hole cover automatically venting said inner cavity upon sufficient steam generation by said food charge.

In some embodiments, the container further comprises a bottom member attached to the casing and juxtaposed the pull-tab lid. In other embodiments, the bottom member and the pull-tab lid are similarly shaped. The vent-hole defined by an edge can be located anywhere on the container. In some embodiments, the vent hole is disposed adjacent or within the removable portion of the pull-tab lid.

Since the container is intended to handle a variety of foods, in particular corn kernels and greasy, fatty and/or butter-like agents, some embodiments can include an expandable casing further comprising a flexible outer ply surrounding and affixed to the flexible panel of the casing.

Some foods may require direct heat along with microwave heating in order to cook well. Microwave susceptors can provide direct heat to microwavable foods during cooking. Thus, another embodiment of the invention further comprises a microwave susceptor interposed the flexible panel and outer ply of the casing.

Other features, advantages and embodiments of the invention will be apparent to those skilled in the art by the following description, accompanying examples and appended claims.

BRIEF DESCRIPTION OF THE DRAWINGS

The following drawings are part of the present specification and are included to further demonstrate certain aspects of the invention. The invention may be better understood by reference to one or more of these drawings in combination with the detailed description of the specific embodiments presented herein.

DETAILED DESCRIPTION OF THE INVENTION

Figure 1:
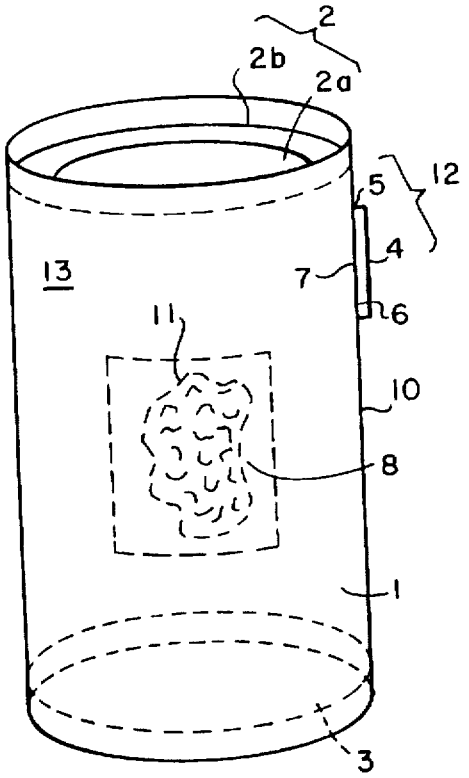
FIG. 1. Perspective view of a first embodiment of the container of the invention.

FIG. 1 depicts a first embodiment of the sealed, automatically self-venting, expandable container of the invention. Container (10) comprises expandable casing (1), pull-tab lid (2), bottom member (3), vent-hole (7), vent-hole cover (12), microwavable food charge (11), and susceptor (8). Container (1) is cylindrical and resembles a soda can in the relative proportion of dimensions, although not in size. Although container (10) is shown fully expanded, it is generally collapsed or folded before cooking in a microwave oven. Bottom member (3) is optional but when present is generally juxtaposed pull-tab lid (2).

The container of the invention functions generally as follows. The collapsed configuration of sealed, automatically self-venting, expandable container (10) is placed in a microwave oven and exposed to microwaves. Microwavable food charge (11) disposed adjacent microwave susceptor (8) contains moisture and generates steam when exposed to the microwaves. As steam is formed, it is retained within inner cavity (13) causing sealed container (10) to expand. During the microwaving process, heat, steam and pressure buildup within the container. Vent-hole cover (12), comprising sheet base (4) and adhesive (5), which is interposed sheet base (4) and casing (1), initially completely covers vent-hole (7) defined by edge (6). However, upon buildup of sufficient internal heat, steam and/or pressure, vent-hole cover (12) automatically uncovers vent-hole (7) thereby automatically self-venting container (10). By "automatically" is meant not requiring a person or operator to mechanically uncover vent-hole (7).

In the embodiment of FIG. 1, expandable casing (1), pull-tab lid (2) and bottom member (3) together define inner cavity (13) of container (10). Expandable casing (1) comprises a substantially microwave transparent, grease resistant, flexible panel. By "substantially microwave transparent" is meant not readily heated by microwave directly and generally microwave permeable. By "grease resistant" is meant generally does not allow materials such as grease, fat, oil, butter and the like to permeate it, thereby maintaining such materials within inner cavity (13).

While the present containers are generally formed from an expandable casing comprising paper, any expandable, substantially microwave transparent, grease resistant, flexible material can be used. The casing material is a non-metallic and microwave permeable material which has sufficient heat resistance to withstand the temperatures on the order of about 325 F. A variety of casing materials can be used such as, by way of example and without limitation: polyolefins, nylon and/or polyester films; grease resistant paper; laminated paper; a two-ply paper comprising a substantially microwave transparent, grease resistant, flexible panel and an outer ply surrounding and affixed to the flexible panel; and combinations thereof. The flexible panel can be a glassine liner which has generally been found to satisfactorily limit grease absorption by the outer ply. The ply can be KRAFT™ paper. Materials for constructing flexible, for example, panel and outer ply members are readily available from companies such as the Thilmany Division of International Paper, Inc. (Kaukauna, Wis.), and Phoenix Packaging (Maple Grove, Minn.). Generally, any commercially available material currently used for making microwavable popcorn bags will be suitable for the invention.

Pull-tab lid (2) can be made in a variety of constructions. As depicted in FIG. 1, pull-tab lid (2) comprises outer periphery (2*b*) which is attached to and completely surrounded by casing (1). FIG. 2*b* depicts another embodiment of the pull-tab lid of the invention. Pull-tab lid (21) comprises removable portion (28) which is substantially concentrically superposed and attached to sheet member (27). Removable portion (28) is removed to permit access to the inner cavity of a container of the invention. Outer periphery (28*a*) of removable portion (28) is adjacent outer periphery (22*c*) of sheet member (27). Sheet member (27) comprises substantially concentric plural perforations (21*a*) formed in a ring which is smaller in diameter than outer periphery (28*a*) of removable portion (28). Plural perforations (21*a*) facilitate removal of removable portion (28).

Pull-tab lid (21) also comprises edge (26) which defines vent-hole (25) which is completely covered by vent-hole cover (29). During microwave cooking, vent-hole cover (29) will loosen to permit venting of heat, steam and/or pressure from an inner cavity of a container through vent-hole (25). Removable portion (28) can be removed by grasping pull-tab (28*a*) formed by incision (22*b* ). After removable portion (28) is removed, portion (33) of sheet member (27) will generally remain.

Removable portion (28) can independently be made from the same materials as described for casing (1). In a preferred embodiment, removable portion (28) is made from heavy stock paper or paperboard.

Removable portion (28) is generally adhered to sheet member (27) using an adhesive that does not loosen or melt during storage or microwave cooking. Such adhesives include, for example, thermoset polymers, polymers having a melting point greater than about 450° F., poly (vinylalcohol), derivatized natural polymers, synthetic polymers, hydroxyethylstarch or cellulose, hydroxypropyl starch or cellulose, hydroxymethyl starch or cellulose, hydroxypropylmethyl cellulose, ethylcellulose, methylcellulose, poly(ethylene terephthalate) and combinations thereof. All such adhesives are readily commercially available.

Figure 2A:
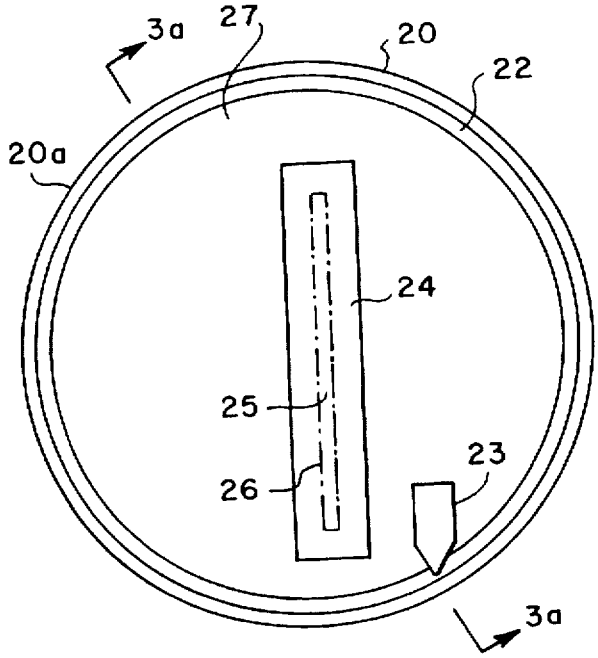
FIGS. 2*a* and 2*b*. Top view of two embodiments of the pull-tab lid of the invention.
Figure 2B:
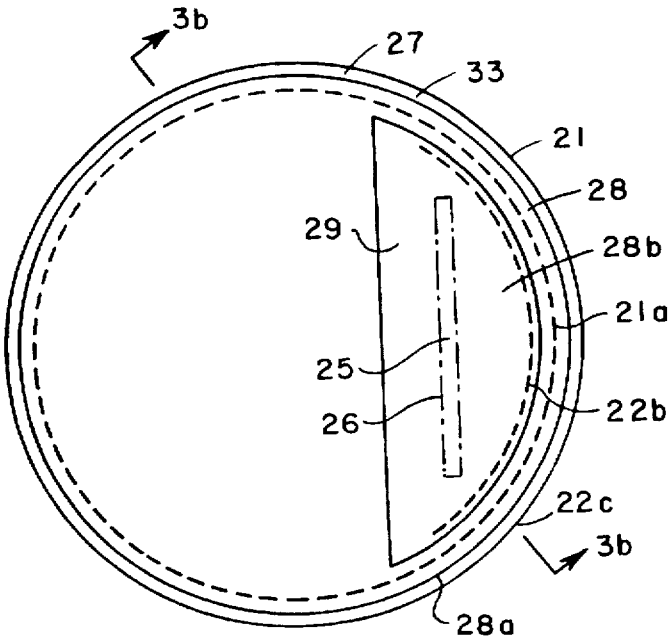

FIG. 2*a* depicts another embodiment of the pull-tab lid of the invention. Pull-tab lid (20) comprises sheet member (27) having outer periphery (20*a*), rip member (22) attached to sheet member (27) and disposed adjacent outer periphery (20*a*), and pull-tab (23) attached to rip member (22). By grasping and pulling pull-tab (23), rip member (22) is dislodged from and tears sheet member (27) thereby removing sheet member (27) from pull-tab lid (20).

Rip member (22) and pull tab (23) can each be independently made from materials such as, by way of example and without limitation, string, thread, wire, a synthetic fiber that does not melt during use, paper, cardboard, paperboard and combinations thereof.

Figure 3A:
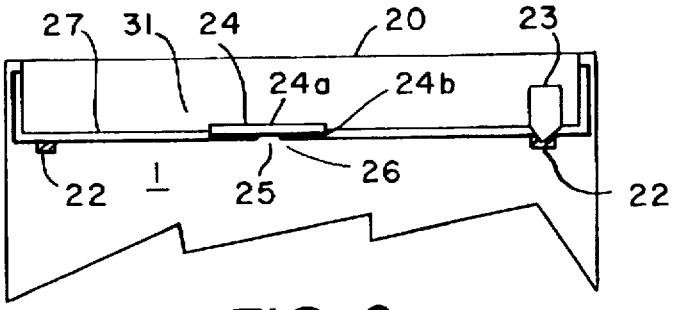
FIGS. 3*a* and 3*b*. Cross-sectional view of two embodiments of the pull-tab lid of the invention.
Figure 3B:
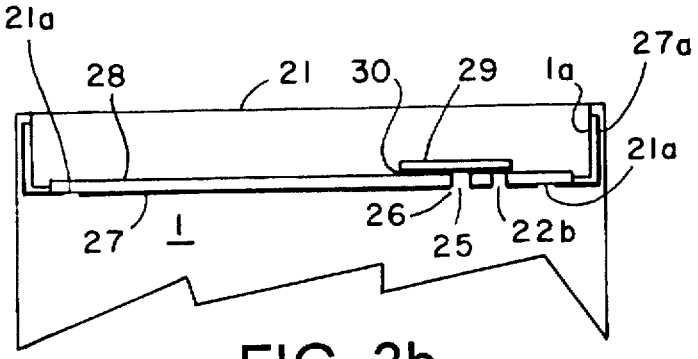
Figure 4:
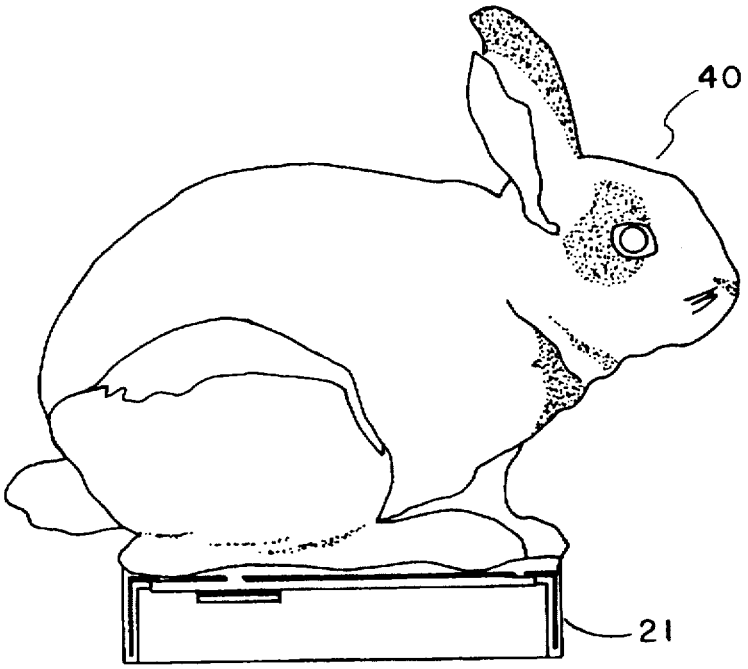
FIG. 4. Perspective view of a second embodiment of the container of the invention.
Figure 5:
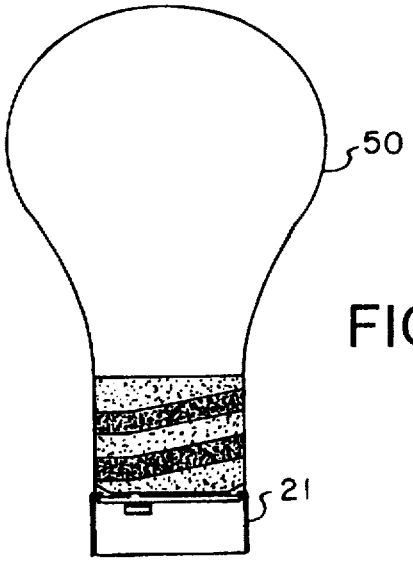
FIG. 5. Perspective view of a third embodiment of the container of the invention.

The pull-tab lid and bottom member of the invention can be attached to the casing in a variety of ways. FIG. 3*b* depicts a cross-sectional view of pull-tab lid (21) of FIG. 2*b*. Casing (1) comprises first peripheral section 1*a*) that folds over second peripheral section (27*a*) of sheet member (27). Sections 1*a*) and (27*a*) are attached to each other by way of an adhesive that generally does not permit the respective sections to become detached during use of the container. FIG. 3*a* depicts a similar method of attachment for casing (1) and sheet member (27). Note that in the embodiments of FIGS. 1, 3*a* and 3*b*, pull-tab lids (2), (20) and (21), respectively, are disposed within casing (1).

Figure 6A:
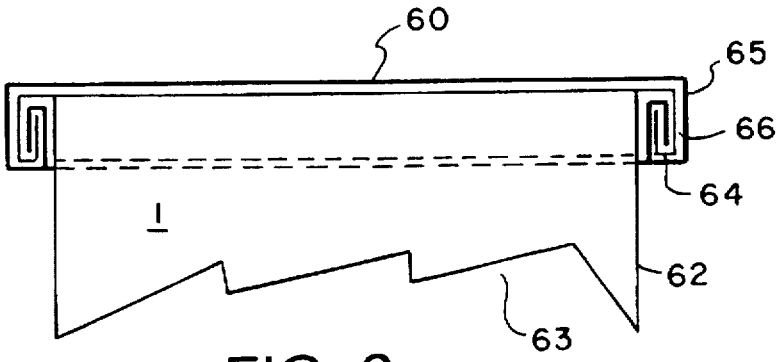
FIG. 6*a*. Cross-sectional view of a first embodiment of a bottom for the container of the invention.

FIG. 6*a* depicts a cross-sectional view of bottom member (60) attached to casing (1). This method of attachment differs from that of FIGS. 3*a* and 3*b* as follows. Bottom member (60) comprises plural folded second peripheral sections (65) interfolded, or intercoiled, with plural folded first peripheral sections (64) of casing (1). An adhesive disposed within chamber (66) defined by plural folded sections (64) and (65) maintains the respective sections attached during use of the respective container.

Figure 6B:
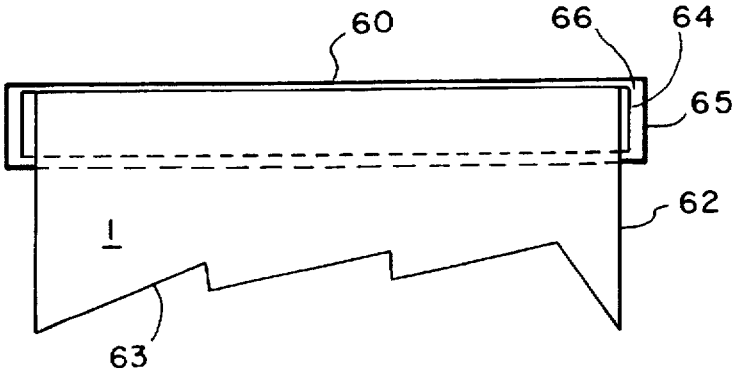
FIG. 6*b*. Cross-sectional view of a second embodiment of a bottom for the container of the invention.

FIG. 6*b* depicts another cross-sectional view of bottom member (60) attached to casing (1). Here, casing (1) comprises single folded first peripheral section (67) disposed within and attached to single folded second peripheral section (68) of bottom member (60). As above, an adhesive disposed within chamber (66) maintains the respective sections attached during use of the respective container.

While different attachment methods have been shown for the pull-tab lids and bottom members of the invention, it should be understood that they are generally interchangeable. Thus, a single container can employ the same or different methods of attachment for its respective pull-tab lid and bottom member.

The pull-tab lid and bottom member of the invention can each be independently shaped as desired. Such shapes include, by way of example and without limitation, circular, elliptical, oblong, square, rectangular, oval triangular, pentagonal, hexagonal, heptagonal, octagonal, polygonal (having nine or more sides), star-shaped (having three or more points), irregular and regular shapes. The pull-tab lid and bottom member are preferably similarly shaped.

The vent-hole of the invention will be defined by a respective edge. It should be noted that the vent-hole of the invention can be disposed anywhere on the container. FIG. 1 depicts vent-hole (7) disposed on casing (1), while FIGS. 2*a*, 2*b*, 3*a* and 3*b* depict vent-hole (25), respectively, disposed on the pull-tab lid of the invention. The vent-hole can also be disposed on the bottom member when present. The vent-hole can comprise a single hole or plural holes as exemplified by plural perforations. The vent-hole can be shaped as desired. In some preferred embodiments, the vent-hole is preferably disposed adjacent or within a removable section of a pull-tab lid.

Referring again to FIG. 3*a*, vent-hole cover (24) superposed sheet member (27) of pull-tab lid (20) comprises sheet base (24*a*) and adhesive (24*b*) interposed the sheet base and edge (26) defining vent-hole (25). Vent-hole cover (24) completely covers vent-hole (25) during initial cooking. However, during microwave cooking and after buildup of sufficient heat, steam and/or pressure within a respective container (not shown), adhesive ((24*b*) loosens permitting escape of the heat, steam and/or pressure thereby venting the respective container.

Sheet base ((24*a*) can comprise any suitable material, such as plastic, cardboard, paperboard, rubber, polymer, paper, film or combinations thereof, currently used to make tape. Adhesive ((24*b*) can comprise any suitable material which will maintain sheet base ((24*a*) covering vent-hole (25) during storage and initial microwave cooking of a respective container, but which will loosen and permit venting of the respective container when sufficient heat, steam and/or pressure has built up within the container. Such materials include plastic, rubber, synthetic polymers, derivatized natural polymers, polyolefins, polyesters, nylons, polyacrylates, pressure sensitive adhesives, repositionable adhesive, poly(alkylene oxides), thermoplastics, poly (alkylene glycols), materials having a melting point greater than about 250° F. and less than about 400° F., and combinations thereof. All such materials are readily available from companies such as Aldrich Chemical Co. (Milwaukee, Wis.) and 3M (Minnesota). Preferred embodiments include polyolefins, polyacrylates, polyesters, repositionable adhesives, pressure sensitive adhesives, and thermoplastics.

In order to improve the heating performance, the containers of the invention can contain one or more microwave susceptors which achieve rapid, even heating of the corn kernels while minimizing the number of unpopped kernels. As explained in the paper "Packaging For The Microwave Oven" presented at the Fifth International Association of The Packaging Research Institute by Michael R. Perry, "microwave susceptors" can consist of metallized PET laminated onto paper or paper board. The metal used in these structures is typically aluminum, which is applied in a thin layer. The density of this thin metallic layer is selected so that it responds to the electromagnetic field of incident microwave radiation, thereby heating the thin metallic layer and thus the interior of an expandable container for cooking microwavable foods. The microwave susceptor of the invention is interposed between the inner and outer panels of the expandable casing.

The container should be completely sealed during initial buildup of internal heat, steam and pressure, since expansion of the container is dependent upon buildup of the three. The container will include a steam generating microwavable food charge disposed within its inner cavity. By "steam generating" is meant that the food will generate steam upon exposure to microwaves from a microwave oven. The steam generation causes the casing to expand.

By "microwavable food charge" is meant any edible composition which can be suitably cooked in a microwave oven. Foods particularly contemplated by the invention include whole grains which can form puffed food such as popcorn or puffed rice. Such grains include corn kernels, milo, rice, wheat, oat, sorghum, millet and the like. The edible composition can include flavor enhancers such as spices and herbs, salt, shortenings, fats, oils, consistency modifiers such as gelatin, starch or cellulose based materials, gums and proteins, and combinations thereof. In some preferred embodiments, the microwavable food charge comprises corn.

Salt can be added to a microwavable food charge prior to placement in the container. When the microwavable food is corn kernels, adding salt helps to distribute oil or fat included with the corn. Generally, the salt must be evenly distributed in the food charge in order to obtain an evenly salted final product. If a large portion of the salt ends up as a layer on the inside of the container, a consumer who wishes his corn saltier than the way it comes simply shakes the container before opening it. The moisture content of the corn is preferably 10%–18% by weight and more preferably from 13%–14% by weight. All quantities and percentages herein are on a weight basis unless otherwise indicated.

Among the various shortenings that can be used are any of the well known edible animal or vegetable oils or fats. Vegetable oils and fats are preferred because of their lower melting points. The most suitable include hydrogenated or unhydrogenated coconut oil, peanut oil, cotton seed oil, soybean oil, corn oil, safflower oil and sunflower oil provided the latter two are of the grade which is relatively high in polyunsaturates. While animal fats can be used, lower melting point oils are preferred because of the tendency of animals fats to solidify and give the finished popcorn a greasy taste. The shortening provides a heat transfer medium for conducting heat evenly between the individual kernels in spite of the presence of hot or cool spots in the package.

EXAMPLE 1

A sealed, expandable, automatically self-venting container according to the invention was made as follows. Commercially available two-ply microwavable popcorn bag paper (Phoenix Packaging, Maple Grove, Minn.) having a microwave susceptor interposed the plys was used to construct a cylinder shaped container (7.43" tall×12.75" circumference) having a pull-tab lid (4" diameter) according to FIGS. 2*b* and 3*b* and a bottom member (4" diameter). Each was attached to the casing with Elmer's™ glue (poly (vinyl alcohol)) according to FIG. 3*b*. The microwavable food charge within the container included corn kernels, oil, vegetable fat and salt (¼ cup total volume for the food charge). Repositionable tape from 3M was used as the vent-hole cover. The collapsed container was exposed to microwaves in a microwave oven equipped with a turntable. The sealed container expanded during the cooking process as steam, heat and pressure built-up within, and corn kernels popped. After sufficient heat, steam and/or pressure built up, the vent-hole cover became detached. The final expanded container was in the shape of a cylinder, or soda can.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

Following long-standing patent law convention, the terms "a" and "an" mean "one or more" when used in this specification.

What is claimed is:

1. A sealed, self-venting, expandable container for cooking a microwavable food in a microwave oven comprising:

an expandable casing consisting of a substantially microwave transparent, grease resistant, inner flexible panel and an outer flexible paper ply surrounding and affixed to said flexible panel;

a pull-tab lid, having an arcuate outer periphery, attached to said casing, said lid and casing together defining a sealed inner cavity;

an edge defining a vent-hole in a removable portion of said pull-tab lid;

a vent-hole cover comprising a sheet base and an adhesive interposed said sheet base and said edge defining a vent-hole, said vent-hole cover completely covering the vent hole;

a steam generating microwavable food charge disposed within said inner cavity, said microwavable food charge comprising corn kernels which expand to form popcorn when exposed to microwaves;

said casing expanding when said food charge is exposed to microwaves in a microwave oven;

said container being shaped as a cylinder, can, animal, person, building, caricature, vehicle or weapon, said vent-hole cover automatically venting said inner cavity upon sufficient steam generation by said food charge; and said pull-tab lid having a removable portion to permit access to said inner cavity.

2. The sealed, self-venting, expandable container of claim 1, wherein:

said container further comprises a bottom member which is attached to said casing and is disposed opposite said pull-tab lid; and said container is shaped as a cylinder.

3. The sealed, self-venting, expandable container of claim 2, wherein said pull-tab lid and said bottom are each circular.

4. The sealed, self-venting, expandable container of claim 1, wherein said expandable casing further comprises:

a microwave susceptor interposed said flexible panel and said outer ply.

5. The sealed, self-venting, expandable container of claim 1, wherein said pull-tab lid comprises a removable portion superposed a sheet member having a plurality of perforations forming a shape smaller in diameter than said removable portion.

6. The sealed, self-venting, expandable container of claim 1, wherein said container is shaped as a caricature and further comprises a plurality of attached, flexible, outer, paper plies surrounding and affixed to said flexible panel.

* * * * *